US006793251B2

(12) United States Patent
Stark

(10) Patent No.: US 6,793,251 B2
(45) Date of Patent: Sep. 21, 2004

(54) BINDER WITH MAGNETICALLY RETAINED PAGES

(76) Inventor: Daniel H. Stark, 311 Greenwich St. #4F, New York, NY (US) 10013

( * ) Notice: Subject to any disclaimer, the term of this patent is extended or adjusted under 35 U.S.C. 154(b) by 0 days.

(21) Appl. No.: 10/200,480

(22) Filed: Jul. 22, 2002

(65) Prior Publication Data

US 2004/0012191 A1 Jan. 22, 2004

(51) Int. Cl.[7] ..... B42D 3/18; B44F 13/00

(52) U.S. Cl. ..... 281/51; 281/2; 281/DIG. 1; 281/5; 281/15.1; 281/21.1; 281/30; 281/45; 283/82; 402/79; 402/503; 40/124.4; 40/600; 273/239; 434/73; 434/168; 434/190; 24/503

(58) Field of Search ..... 281/2, DIG. 1, 281/5, 15.1, 21.1, 30, 45, 51; 402/503, 79; 434/73, 168, 190; 273/239; 40/124.4, 600, 124.04; 24/503; 283/82

(56) References Cited

U.S. PATENT DOCUMENTS 3,145,326 A * 8/1964 McGannon ..... 335/285
3,751,839 A * 8/1973 Mitchell ..... 40/775
4,466,639 A * 8/1984 Finnegan ..... 281/45
5,328,206 A * 7/1994 Scott ..... 281/38
5,709,409 A * 1/1998 Engel ..... 281/29
5,820,383 A * 10/1998 Levins ..... 434/238
6,273,660 B1 * 8/2001 Ozgen et al. ..... 412/1

FOREIGN PATENT DOCUMENTS

FR 774664 * 5/1957
FR 1182480 * 2/1970
GB 631466 * 11/1949
JP 03153397 A * 7/1991 ..... B42F/1/02

* cited by examiner

*Primary Examiner*—Andrea Wellington
*Assistant Examiner*—Mark Henderson
(74) *Attorney, Agent, or Firm*—Tarolli, Sundheim, Covell & Tummino L.L.P.

(57) ABSTRACT

A binder has a front cover and a back cover. A first page assembly for mounting in the binder includes a first magnet. A second page assembly for mounting in the binder in an overlying relationship with the first page assembly includes a second magnet for releasably attaching the second page assembly to the first page assembly in the binder. Each one of the page assemblies may include a magnet portion, a hinge portion, and a display portion, which may be all formed as one piece. The binder has a base member, made of a magnetic material, to which the magnets are attracted to mount the page assemblies in the binder.

51 Claims, 5 Drawing Sheets

BINDER WITH MAGNETICALLY RETAINED PAGES

BACKGROUND OF THE INVENTION

1. Technical Field

The present invention relates to the binding of pages into a binder. In particular, the present invention relates to the use of magnets to hold pages together, for example, in a binder.

2. Description of the Prior Art

It is known to use one or more magnets to retain individual sheets or pages in a binder. For example, McGannon U.S. Pat. No. 3,145,326 shows a binder that includes permanent magnets fixed on the inside of the spine. Sheets to be stored in the binder each have secured to them projecting tabs made of a magnetic material. When the tabs are moved to a position adjacent to the spine, the tabs are attracted to the permanent magnets, to hold the sheets in place in the binder. Takahashi U.S. Pat. No. 5,575,503 shows a similar arrangement using electromagnet(s) on the spine or other part of the cover to hold in a plurality of individual sheets each of which has a magnetic material on its edge to be bound.

SUMMARY OF THE INVENTION

The present invention relates to the binding of pages into a binder. In particular, the present invention relates to the use of magnets to hold pages in a binder. In one embodiment, the present invention relates to apparatus comprising a binder having a front cover and a back cover; a first page assembly for mounting in the binder, including a first magnet; and a second page assembly for mounting in the binder in an overlying relationship with the first page assembly,. The second page assembly includes a second magnet for releasably attaching the second page assembly to the first page assembly in the binder. Each one of the page assemblies may include a magnet portion, a hinge portion, and a display portion, which may be all formed as one piece.

In another embodiment, the present invention relates to apparatus comprising a binder having a front cover and a back cover, and a plurality of page assemblies. Each one of the page assemblies has an inner side portion for mounting in the binder, each one of the inner side portions of the plurality of page assemblies including a respective magnet. The page assemblies are mountable in the binder with the magnets of the page assemblies disposed in a stacked relationship in the binder thereby to removably maintain the page assemblies in an overlying relationship in the binder. The binder includes means for securing the page assemblies in the binder.

BRIEF DESCRIPTION OF THE DRAWINGS

The foregoing and other features of the present invention will become apparent to one skilled in the art to which the present invention relates upon consideration of the following description of the invention with reference to the accompanying drawings, in which.

DETAILED DESCRIPTION OF THE INVENTION

The present invention relates to the binding of pages into a binder. In particular, the present invention relates to the use of magnets to hold pages together, for example, in a binder or cover. (As used herein, the terms "magnet", "magnetizable material", and "magnetic material" are given their common meanings, which are understood to be as follows. "Magnet" means a body that provides a magnetic field; a body that possess the property of attracting magnetic materials. "Magnetizable material" means a material that can be magnetized (by the magnetic field from another magnet) thereby to become a magnet—for example, iron. "Magnetic material" means a material that is attracted to a magnet, but that does not itself provide a magnetic field.)

Figure 1:
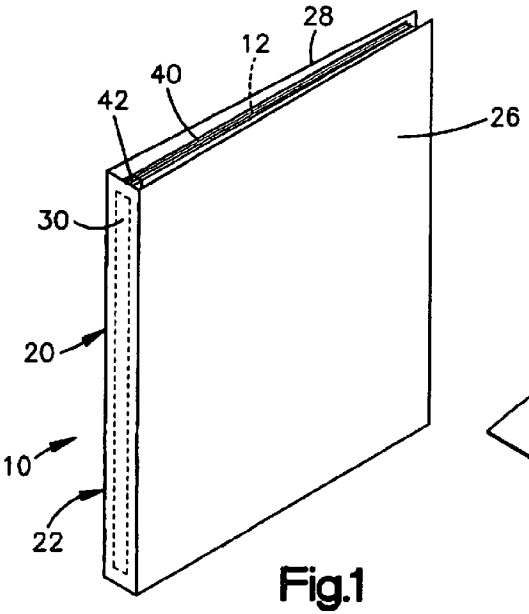
FIG. 1 is a front perspective view of a binder assembly in accordance with the present invention, shown in a closed condition.
Figure 2:
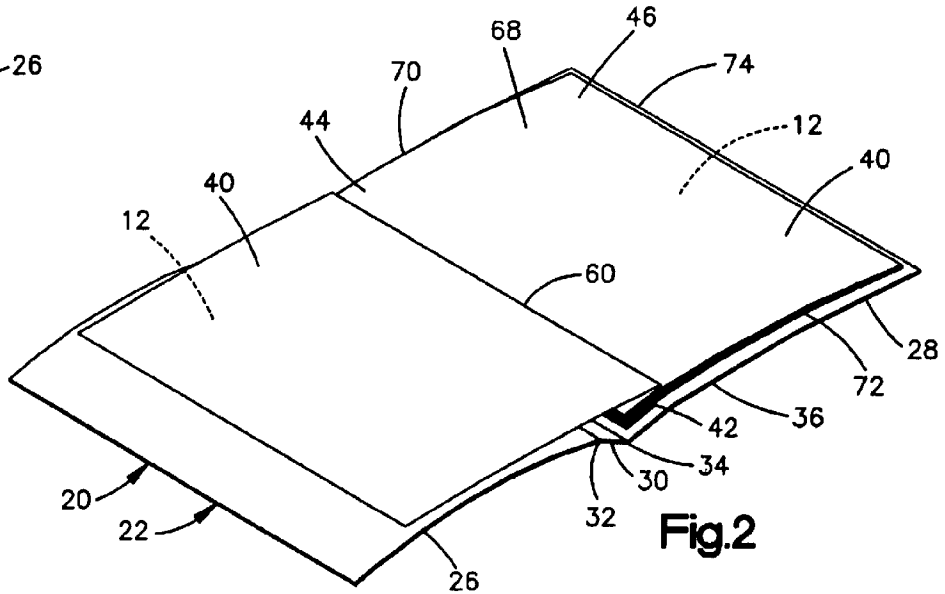
FIG. 2 is a perspective view of the binder assembly of FIG. 1 shown in an open condition with one page assembly overlying the front cover and a plurality of page assemblies overlying the back cover.
Figure 3:
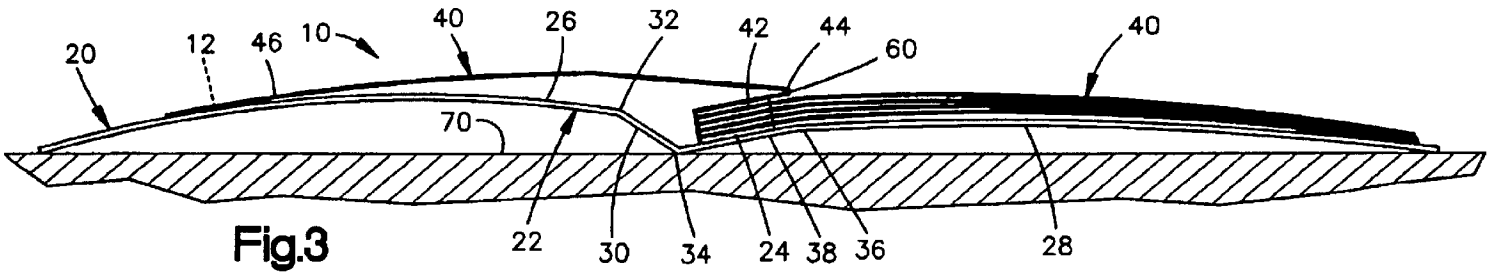
FIG. 3 is a bottom elevational view of the binder assembly of FIG. 1 shown in the open condition.

As representative of the present invention, FIGS. 1–3 illustrate an apparatus in the form of a binder assembly 10 constructed in accordance with a first embodiment of the invention. The binder assembly 10 is used for displaying sheets of display material 12. The binder assembly 10 includes a binder 20, and a plurality of page assemblies 40 mounted in the binder.

The binder 20 (FIGS. 1–3) includes a cover 22 and a base member 24. The cover 22 is shown as being a one-piece plastic construction including a front cover 26, a back cover 28, and a spine 30 located between the front cover and the back cover. The cover 22 could be made from other materials, and could have a different construction and/or configuration than those shown and described herein.

The cover 22 is scored at 32 between the front cover 26 and the spine 30, and at 34 between the spine 30 and the back cover 20, to provide for predetermined areas of hinging (bending) for opening the cover. An additional score line 36 is provided in the back cover 28, near the spine 30.

The base member 24 is located on a portion 38 of the back cover 28, near the spine 30, between the score lines 34 and 36. The base member 24 extends for substantially the full height of the cover 22, from top to bottom. The base member 24 is a member that is attracted to a magnet. The base member 24 therefore could be a member made of a magnetic material, or could be another magnet. The base member is secured to the cover 22 in a manner described below. It should be understood that the present invention is applicable also to binders that do not include a base member—that is, binder assemblies that include page assemblies magnetically attracted to each other but not to the cover.

Figure 4:
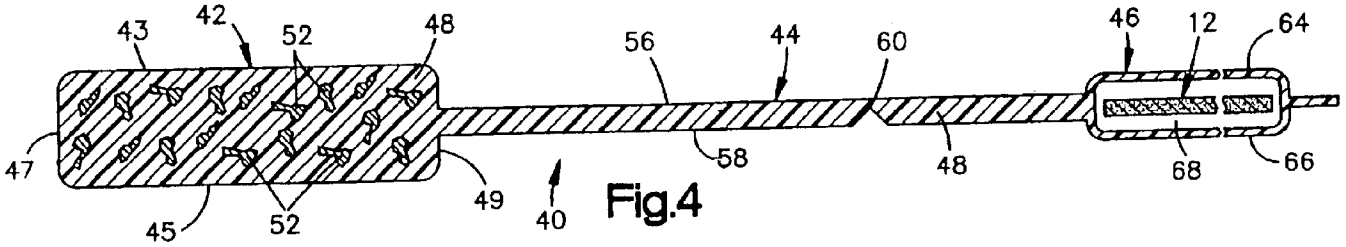
FIG. 4 is a sectional view, partially broken away, of a first embodiment of a page assembly in accordance with the present invention.

FIG. 4 illustrates one type of page assembly 40 that is usable in the present invention. Alternative types of page assemblies are described below. The page assembly 40 includes a magnet portion 42, a hinge portion 44, and a display portion 46.

The page assembly 40 is preferably formed as single unitary one piece. More preferably, the page assembly 40 is formed from a moldable plastic material 48 that has the following characteristics: flexibility, strength to hold the display material 12 over repeated flexings, cost efficiency, and design aesthetics. One suitable material for the page assembly is extruded or molded vinyl.

The magnet portion 42 of the page assembly 40 has a generally rectangular cross-sectional configuration, as can be seen in FIG. 4. The magnet portion 42 has a bar-shaped or strip-shaped configuration extending the length (from top to bottom as viewed in FIG. 1) of the page assembly 40.

The magnet portion 42 has parallel, flat upper and lower major side surfaces 43 and 45, and parallel, flat inner and outer minor side surfaces 47 and 49. The length and width of the magnet portion 42 are similar to the length and width of the base member 24 of the binder 20. In one embodiment, the magnet portion 42 has a dimension of about one-half inch in width, and about one-sixty-fourth inch in thickness. The magnet portion 42 could be wider or narrower, and could be thicker or thinner. The magnet portion 42 is preferably as thin as possible while still providing the needed magnetic strength.

Figure 5:
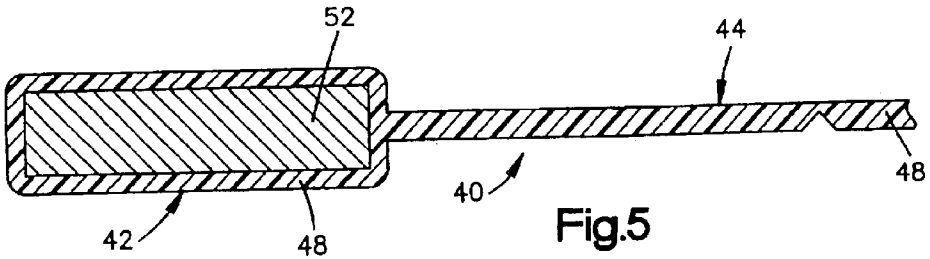
FIG. 5 is a sectional view of a second embodiment of a page assembly in accordance with the present invention.

The magnet portion 42 of the page assembly 40 includes a magnet 52 embedded in the plastic body material 48 of the magnet portion 42. The magnet 52 as shown in FIG. 4 is a plurality of magnetic pieces, or particles. The magnet 52 may, as shown in FIG. 5, alternatively be a single magnetic piece, such as a strip magnet. Such a magnet may be purchased from McMaster-Carr company, online at mcmaster.com, "flexible magnetic stripping". The magnet 52, whether in powder form or in solid form, is preferably embedded during the process of forming of the plastic body 48 by molding, for example, by injection molding.

The hinge portion 44 of the page assembly 40 in the illustrated embodiment is formed as a sheet or tab that extends outward from the outer side surface 49 of the magnet portion 42. The hinge portion 44 (FIG. 44) has parallel upper and lower major side surfaces 56 and 58, and in the illustrated embodiment is thinner than the magnet portion 42. Preferably they are the same thickness.

The hinge portion 44 preferably includes a predetermined weakened portion 60 for encouraging hinging of the page assembly 40 at a predetermined location. In the illustrated embodiment, the predetermined weakened portion 60 is formed by a score line that is spaced apart from the magnet portion 42. The width of the hinge portion 44 and the spacing of the score line 60 are selected so that the page assemblies 40 can lie flat or substantially flat on either the front cover 26 or the back cover 28, as described below. The hinge portion could include a predetermined weakened portion formed in another manner. A hinge portion made from fabric would not need a predetermined weakened portion.

The display portion 46 of the page assembly 40 is formed as an outwardly extending (away from the magnet portion 42) continuation of the hinge portion 44 of the page assembly. The display portion 46 is designed to support the display material 12. This can be done in different ways. One embodiment is illustrated in FIG. 4. Other types of display portions may be provided.

In the embodiment illustrated in FIG. 4, the display portion 46 includes two spaced apart layers 64 and 66 that together define a pocket 68 for receiving the display material 12—like a sheet protector. The pocket 68 (FIG. 2) has an open top edge 70, a bottom edge 72, and an outer side edge 74. The pocket 68 may be, for example, sized to accommodate an 8.5×11 inch display item, or could be substantially larger, for example up to 16×20 inches or more. The display material 12 could be a photograph, for example.

Figure 6:
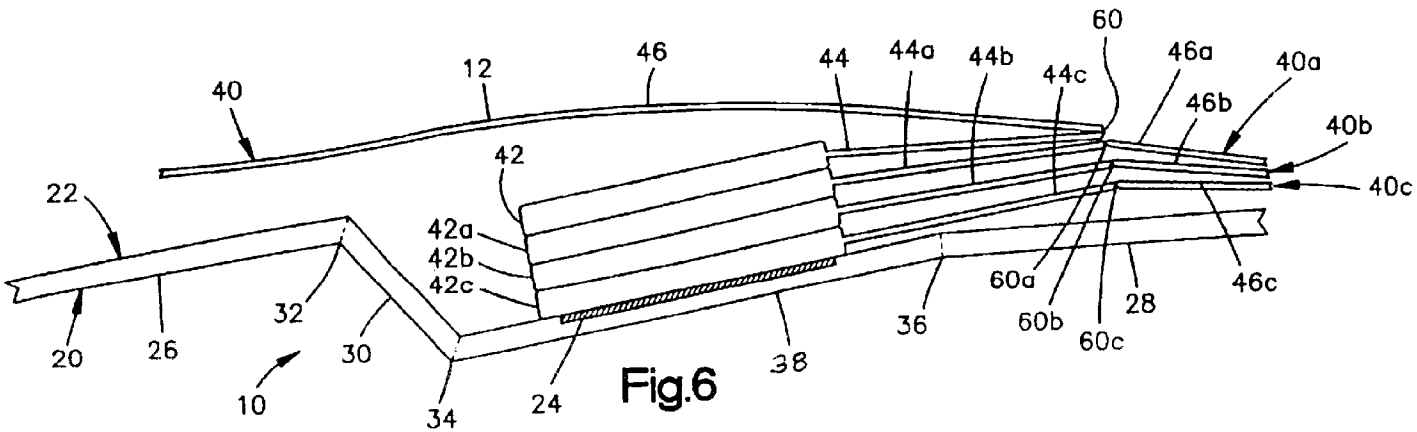
FIG. 6 is an enlarged view of a portion of FIG. 3 showing the magnet portions of the page assemblies in a stacked relationship.
Figure 7:
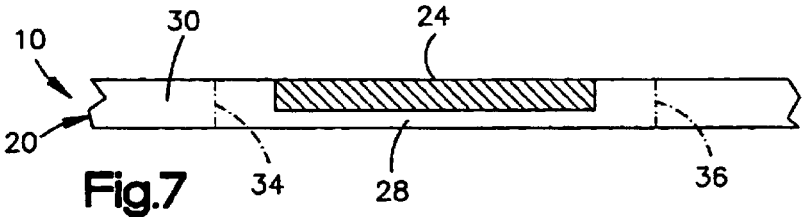
FIG. 7 is a schematic view of a portion of the binder of FIG. 1 showing one alternative method of securing a base member in the binder assembly.

The magnet portion 42 of the page assembly 40 is designed so that the magnetic field provided by the magnet 52 is strong enough to hold the page assembly 40 in position on the binder 20. Specifically, the magnetic field provided by the magnet 52 is strong enough to attract the base member 24 and thereby releasably attach (magnetically) the page assembly 40 to the binder 20. When the magnet portion 42 of the page assembly 40 is placed on or in a position overlying the base member 24, as shown in FIG. 6, the magnet 52 of the page assembly 40 attracts the base member 24. The magnetic attraction is strong enough to clamp, or releasably attach, the magnet portion 42 to the base member 24. As a result, the entire page assembly 40 is releasably attached to the binder 20. The page assembly 40 may be removed from the binder 20 by separating the magnet portion 42 of the page assembly from the binder cover 22, breaking the magnetic attraction that holds the pieces together.

As noted above, the binder 20 is designed to hold or mount a plurality of page assemblies 40 in the binder. Such an arrangement is shown in FIGS. 1–3 and 6. In these drawings, there are shown the binder 20 and the page assembly 40. There are also shown three additional page assemblies 40*a*, 40*b* and 40*c* that are identical or similar to the page assembly 40. The page assemblies 40*a*–40*c* are mounted in the binder 20 with their magnet portions 42*a*–42*c* disposed in a stacked relationship on the magnet portion 42 of the page assembly 40 and thereby over the base member 24. The magnet portions 42*a*–42*c* of the three page assemblies 40*a*–40*c*, and the magnet portion 42 of the page assembly 40, all magnetically attract each other and hold the four page assemblies 40, 40*a*, 40*b* and 40*c* together as a group. The magnetic attraction between the magnet portion 42 of the one page assembly 40 and the base member 24, holds the stack of four page assemblies 40–40*c* in the binder 20. As a result, all four page assemblies 40–40*c* are releasably attached, or removably maintained, in the binder 20.

When the binder assembly 10 is opened to view some of the display materials 12 in the page assemblies 40, the front cover 26 is laid open (to the left as viewed in FIG. 3). The cover 22 bends at the score line 32 between the front cover 26 and the spine 30 to allow the front cover to lie open or flat on the underlying support surface 70. The cover 22 also bends at the score line 34 between the spine 30 and the back cover 26. In addition, the cover 22 bends at the score line in the back cover 36. The score line 36 is preferably underneath the hinge portions 44–44*c* of the page assemblies 44. Together these features enable the spine 30 to lift off the support surface 70 between the spine and the back cover 26. The stack of magnet portions 42 tips up off the surface 70. This enables the back cover 28 to lie substantially horizontal for good viewing. The width of the magnet portions 42–42*c*, the location of the score lines 60–60*c*, and the locations of the score lines 33, 34 and 36 are all selected together to enable this to occur.

When the page assemblies 40–40*c* are in the binder 20, they may be flipped or pivoted between front and back to enable viewing of individual page assemblies. As this occurs, the page assemblies 40–40*c* bend at their hinge portions 44–44*c*. The magnet portions 42–42*c* themselves do not flip over, but instead stay in position stacked on the back cover 26.

In one alternative construction, the binder 20 can be made partially or completely from a magnetic material, such as metal. In this case, a separate base member 24 may be unnecessary.

Figure 8:
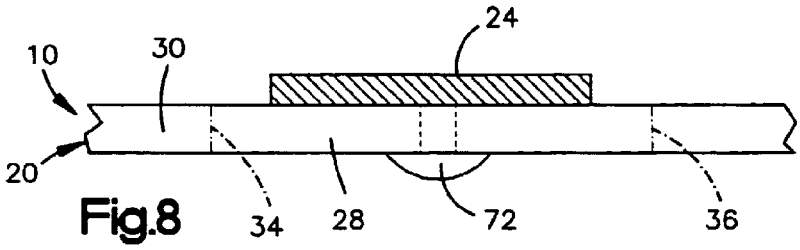
FIG. 8 is a view similar to FIG. 7 showing another alternative method of securing a base member in the binder assembly.

The base member 24 can be mounted to the cover 20 in various ways. In the embodiment shown in FIGS. 1–7, and discussed above, the base member 24 is a magnet or metal strip that is glued or otherwise adhered to the cover 20. The base member 24 may be embedded in (molded with or bonded into) the cover 20, as shown, or surface mounted. In the embodiment shown in FIG. 8, the base member 24 is a metal strip (or magnet) that is riveted or otherwise secured to the cover 20 with fasteners 72, such as rivets.

As noted above, alternative types of page assemblies are usable in the present invention. The alternative types of page assemblies may have a different construction for the magnet portion, for the hinge portion, and/or for the display portion.

Figure 9:
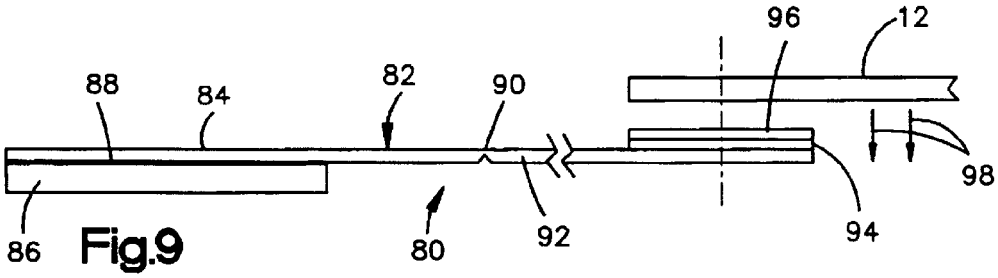
FIG. 9 is a sectional view, partially broken away, of a third embodiment of a page assembly in accordance with the present invention.

One alternative type of page assembly 80 is shown in FIG. 9. The page assembly 80 may be used when it is desired that the display material 12 be open (exposed) on both sides, rather than received in a pocket as with the page assembly 40 (FIG. 4).

This page assembly 80 includes a hinge portion 82, or hinge, that is made from a strong, flexible sheet material, such as the material 48 of the page assembly 40. On a first section 84 of the hinge 82 there is mounted a magnet 86. The magnet 86 may be similar in construction to the strip magnet 52 discussed above with reference to FIG. 5. The magnet 86 is adhered by glue or adhesive 88 to the first section 84 of the hinge 82, rather than being embedded as in FIG. 5.

The hinge 82 has a predetermined weakened portion in the form of a score line 90 for guiding the hinge to bend at that location. On the opposite side of the score line 90 from the magnet 86 is a display portion 92 of the hinge 82. The display portion 92 is a width of the material of the hinge 82 that is wide enough to support the display material 12.

The hinge 82 includes an adhesive 94 that may be covered by a release paper 96. Removal of the release paper 96 enables display material 12 to be adhesively secured to the hinge 82 by movement in a direction as indicated by the arrows 98. This page assembly 80 has the advantage of being small in dimension, easily attached to display material 12, and open in the area of the display material. The hinge 82 could have adhesive on both sides, as an alternative.

Figure 10:
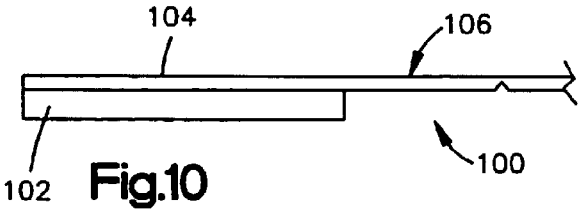
FIG. 10 is a sectional view, partially broken away, of a fourth embodiment of a page assembly in accordance with the present invention.

Another alternative type of page assembly 100 is shown partially in FIG. 10. In this page assembly 100, the magnet portion includes a magnet 102 that is self-adhered as by molding of the material of the hinge member 106 to a section 104 of the hinge member.

Figure 11:
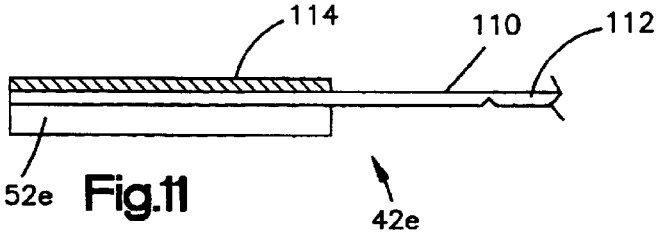
FIG. 11 is a sectional view, partially broken away, of a fifth embodiment of a page assembly in accordance with the present invention.

FIG. 11 shows a magnet portion 42*e* that can be used with any of the page assemblies of the present invention, especially those with an exposed magnet. In the magnet portion 42*e* (FIG. 11), a magnet 52*e* is located on one side of the sheet material 110 of the hinge 112. A metal strip 114 made of a magnetic material is located on the other side, with the sheet material 110 of the hinge 112 sandwiched between them. The metal strip 114 serves to provide a more decorative appearance to the one side of the magnet portion 42*e* of the page assembly. In addition, the metal strip 114 provides a magnetic material to which a magnet portion of an adjacent page assembly can be attracted. Because the metal strip 114 is a magnetic material rather than a magnet itself, it does not have strong poles. Therefore, a magnet portion of an adjacent page assembly can, in some cases, be aligned more precisely with the metal strip 114, as compared to alignment with another magnet.

Figure 12:
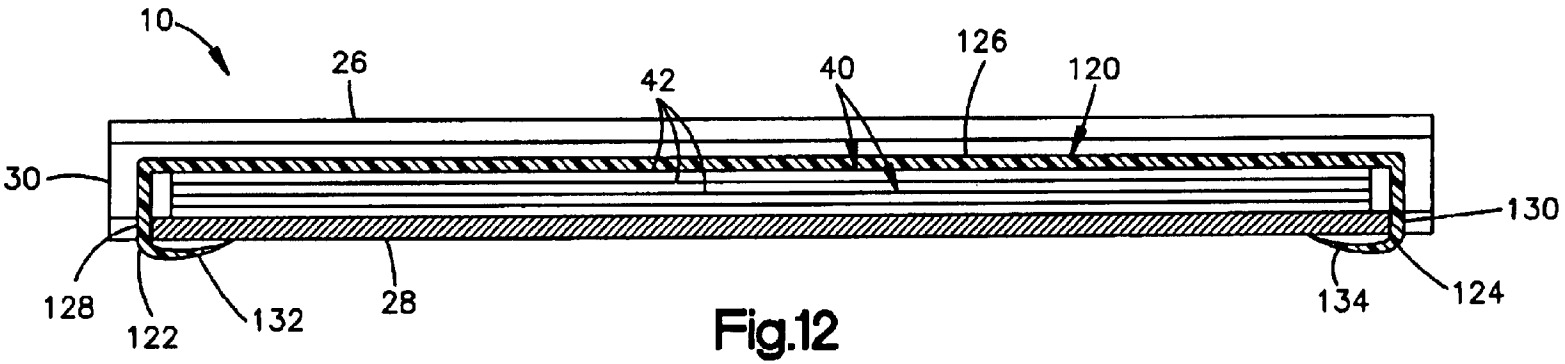
FIG. 12 is a schematic view showing a clip that may be used to help maintain page assemblies in a binder.

A binder assembly in accordance with the present invention may optionally include a device to help hold the magnet portions of the page assembly to the binder. As one example, FIG. 12 is a section through the binder assembly 10, taken through the magnet portions 42 in a direction looking toward the spine 30. The top of the binder assembly 10 is to the right as viewed in FIG. 12, and the bottom of the binder assembly is to the left as viewed in FIG. 12.

The binder assembly 10 includes a clip 120. The clip 120 in the illustrated embodiment is a plastic member having a width approximately the same as that of the magnet portions 42, but could be made from metal. The clip 120 has a generally C-shaped configuration as seen in FIG. 12. The clip 120 includes a first end portion 122, a second end portion 124, and a central portion 126 that extends between and interconnects the first and second end portions.

The back cover 26 includes two slots 128 and 130 adjacent the ends of the stack of magnet portions 42. The first end portion 122 of the clip 120 extends through the slot 128 in the back cover 28. A first terminal end portion 132 of the clip 120 clamps against the back cover 28, at a location between the two slots 128 and 130.

The second end portion 124 of the clip 120 is a mirror image of the first end portion 122. The second end portion 124 extends through the other slot 130 in the back cover 28. A second terminal end portion 134 of the clip 120 clamps against the back cover 28, at a location between the two slots 128 and 130.

The clip 120 is made from a resilient material that enables it to be bent along its central portion 126 so that the end portions 122 and 124 may be lifted into the slots 128 and 130. When the clip 120 is installed as shown in FIG. 12, it applies a clamping force (upward and downward as viewed in FIG. 12) that tends to hold the magnet portions 42 of the page assemblies 40 tight against the back cover 28.

Figure 13:
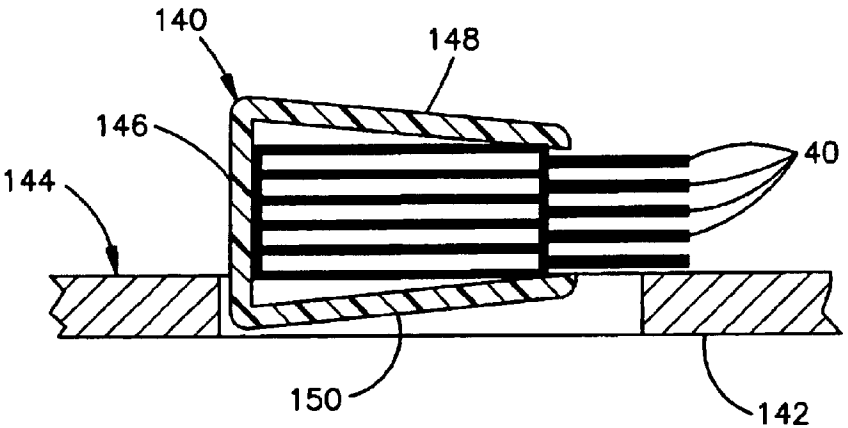
FIG. 13 is a schematic view showing another clip that may be used to help maintain page assemblies in a binder.

FIG. 13 illustrates an alternative clip design. The clip 140 is mounted in a manner not shown on the back cover 142 of a binder 144. The clip 140 has a C-shaped configuration as viewed in cross-section in FIG. 13, including a base 146 and two legs 148 and 150. The clip is preferably made from a resilient material, such as spring steel, so that the legs 148 and 150 clamp on a plurality of page assemblies 40.

Figure 15:
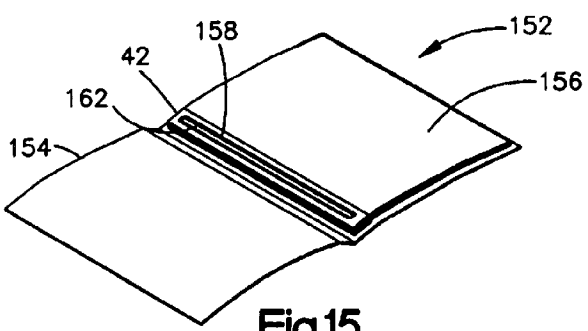
FIG. 15 is an assembled view of the binder and page assemblies of FIG. 14.
Figure 14:
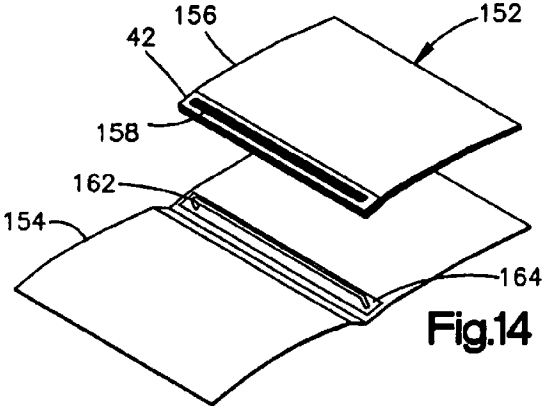
FIG. 14 is an unassembled view of a binder and page assemblies in accordance with a further embodiment of the invention.

FIGS. 14 and 15 illustrate a binder assembly 152 that is a further embodiment of the invention, which includes additional lateral positioning support for page assemblies. Specifically, the binder assembly 152 includes a binder 154 and a plurality of page assemblies 156. The page assemblies 156 are similar to those shown above at 40, with the exception that each one additionally has a slot 158 through its magnet portion 42.

The binder 154 includes a bar 162 that projects upward from the back cover, over the base member 164. The page assemblies 156 fit over the bar 162 which extends through the slots 158. The bar 162 limits movement of the page assemblies 156 relative to the binder 160. This is exemplary of the concept of providing additional lateral positioning support for the page assemblies.

Figure 16:
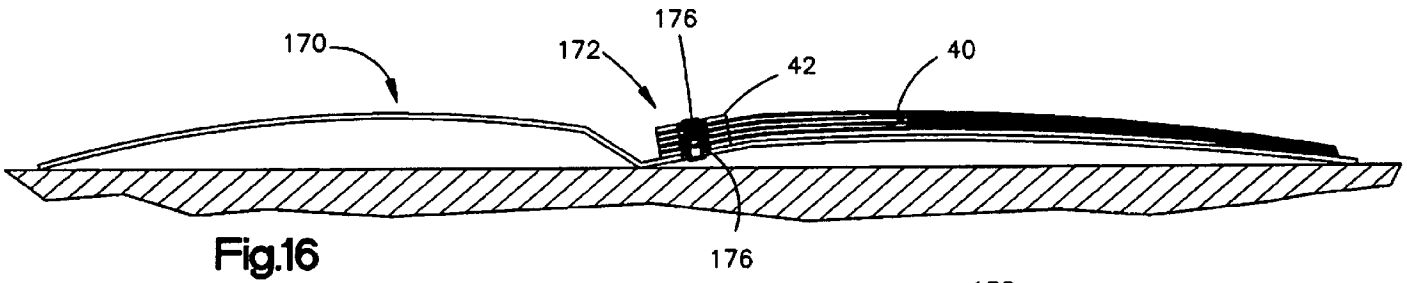
FIG. 16 is an assembled view of a binder and page assemblies in accordance with a still further embodiment of the invention.

Another example of providing additional lateral positioning support for the page assemblies is shown in FIG. 16. FIG. 16 shows a binder assembly 170 that is similar to the one shown in FIG. 1. Additionally, the binder assembly 170 of FIG. 16 includes a post binding system 172 of a known type. Each one of the magnet portions 42 of the page assemblies 40 has one or more openings for receiving an equal number of posts 176 of a known configuration. The posts 176 limit movement of the page assemblies 40 relative to the cover, thereby providing additional lateral positioning support for the page assemblies.

Figure 17:
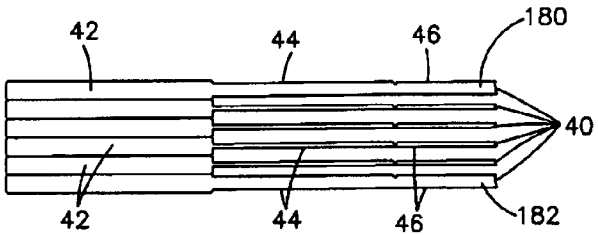
FIG. 17 is a view of a plurality of page assemblies shown in use without a binder.

FIG. 17 illustrates a stack of page assemblies 40 that is usable without a separate binder. Each one of the page assemblies 40 includes a magnet portion 42, a hinge portion 44, and a display portion 46. The upper and lower page assemblies 180 and 182 may be thicker, as shown, to serve as covers. As a result, a binder may not be needed, as the stack of page assemblies 40 forms a functional unit on its own.

From the above description of the invention, those skilled in the art will perceive improvements, changes and modifications in the invention. Such improvements, changes and modifications within the skill of the art are intended to be covered by the appended claims.

Having described the invention, I claim:

1. Apparatus comprising:

a binder having a front cover and a back cover;

a first page assembly for mounting in said binder, said first page assembly formed as a single unitary piece including a first sheet having a first surface connected to a first magnet;

a second page assembly for mounting in said binder in an overlying relationship with said first page assembly, said second page assembly formed as a single unitary piece including a second sheet connected to a second magnet, for releasably attaching said second page assembly to said first page assembly in said first page assembly further includes a metal strip connected oppositely adjacent to said first surface of said first sheet, for magnetic attraction by said second magnet of said second page assembly for releasably attaching said second page assembly to said first page assembly.

2. Apparatus as set forth in claim 1 wherein said first and second magnets are magnetically attracted to each other thereby to form a stack in which said second page assembly is releasably attached to said first page assembly.

3. Apparatus as set forth in claim 1 further including a plurality of page assemblies in addition to said first and second page assemblies, each additional page assembly including a respective magnet, said first and second magnets and said magnets of said additional page assemblies together forming said stack.

4. Apparatus as set forth in claim 2 wherein said binder includes a base member to which said stack is magnetically attracted thereby to mount said first and second page assemblies in said binder.

5. Apparatus as set forth in claim 4 wherein in which said base member is a magnet.

6. Apparatus as set forth in claim 4 wherein said base member is not a magnet but is made from a magnetic material.

7. Apparatus as set forth in claim 3 wherein said binder includes a base member of magnetic material to which said stack is magnetically attracted thereby to mount said first and second page assemblies and said plurality of additional page assemblies in said binder.

8. Apparatus comprising:

a binder having a front cover and back cover;

a first page assembly for mounting in said binder, including a first magnet, said first page assembly includes a magnet portion in which said first magnet is disposed, a hinge portion, and a display portion, said magnet portion, hinge portion, and display portion all being formed as one single unitary piece; said hinge portion being disposed between said magnet portion and said display portion, and a second page assembly for mounting in said binder in an overlying relationship with said first page assembly, said second page assembly including a second magnet for releasably attaching said second page assembly to said first page assembly in said binder.

9. Apparatus as set forth in claim 8 wherein said first and second magnets are magnetically attracted to each other thereby to form a stack in which said second page assembly is releasably attached to said first page assembly.

10. Apparatus as set forth in claim 8 wherein said binder includes a base member to which said stack is magnetically attracted thereby to mount said first and second page assemblies in said binder.

11. Apparatus as set forth in claim 8 further including a plurality of page assemblies in addition to said first and second page assemblies, each additional page assembly including a respective magnet, said first and second magnets and said magnets of said additional page assemblies together forming said stack.

12. Apparatus as set forth in claim 8 wherein each one of said first and second page assemblies ha a respective inner side portion for connection with said binder and respective opposite outer side portion, said first and second magnets being located on said inner side portions of said page assembiles when said first and second page assemblies are mounted in said binder.

13. Apparatus as set forth in claim 8 wherein said first page assembly is made from a flexible plastic material, and said magnet portion includes a magnet embedded in or adheared to a first portion of said flexible plastic material, said hinge portion includes a sheet-form second portion of said plastic material, and said display portion includes a third portion of said flexible plastic material that is adapted to secure a display item on said page assembly in said binder, said hinge portion enabling pivotal movement of said display portion relative to said magnet portion and relative to said binder to move said display item between a postion overlying said back cover and a position overlying said front cover.

14. Apparatus as set forth in claim 8 wherein said magnet portion comprises a strip magnet or bar magnet.

15. Apparatus as set forth in claim 8 wherein said magnet portion comprises a plurality of magnet pieces embedded in a plastic material.

16. Apparatus as set forth in claim 8 wherein said magnet portion comprises a strip magnet or bar magnet adhered to a plastic material, said plastic material also forming said hinge portion of said page assembly.

17. Apparatus as set forth in claim 8 further including means connected with said page assemblies for providing additional lateral support for said page assemblies in said binder.

18. Apparatus as set forth in claim 10 wherein in which said base member is a magnet.

19. Apparatus as set forth in claim 10 wherein said base member is not a magnet but is made from a magnetic material.

20. Apparatus as set forth in claim 11 wherein said binder includes a base member of magnetic material to which said stack is magnetically attracted thereby to mount said first and second page assemblies and said plurality of additional page assemblies in said binder.

21. Apparatus as set forth in claim 13 wherein said hinge portion of said first page assembly includes a predetermined weakened portion at which said hinge portion is bendable to enable pivotal movement of said display portion.

22. Apparatus comprising:

a binder having a front cover and a back cover;

a plurality of page assemblies, each one of said page assemblies having an inner side portion for mounting in said binder, each one of said inner side portions of said plurality of page assemblies including a respective magnet;

said page assemblies being mountable in said binder with said magnets of said page assemblies disposed in a stacked relationship in said binder thereby to removably maintain said page assemblies in an overlying relationship in said binder;

each one of said page assemblies includes a magnet portion, a hinge portion, and a display portion; and said binder including means for securing said page assemblies in said binder.

23. Apparatus as set forth in claim 22 wherein said means for securing comprises a base member to which said stack of magnets is attracted to secure said page assemblies in said binder.

24. Apparatus as set forth in claim 22 wherein said each one of said page assemblies is made from flexible material, each one of said magnet portions including a magnet embedded in or adhered to said a first portion of said flexible material, each one of said hinge portions including a sheet-form second portion of said flexible material, each one of said display portions including a third portion of said flexible material that is adapted to secure a display item on said page assembly in said binder, said hinge portions enabling pivotal movement of said display portions relative to said magnet portions and to said binder to flip said display items between a position overlying said back cover and a position overlying said front cover.

25. Apparatus as set forth in claim 22 wherein said hinge portion of said first page assembly includes a predetermined weakened portion at which said hinge portion is bendable to enable pivotal movement of said display portion.

26. Apparatus as set forth in claim 22 wherein said magnet portion comprises a magnet embedded in and fully enclosed by plastic material.

27. An apparatus as set forth in claim 22 wherein said hinge portion of each said page assemblies includes a weakened portion which is bendable to enable pivotal movement of said display portion of each of said page assemblies relative to said magnet portion of each of said page assemblies.

28. An apparatus as set forth in claim 22 wherein each of said page assemblies further includes a metal strip which is magnetically attracted by said magnet portion of an adjacent page assembly.

29. An apparatus as set forth in claim 22 wherein said magnet portion, hinge portion, and display portion of each of said page assemblies are all formed as one piece.

30. An apparatus as set forth in claim 22 further including means connected with said page assemblies for providing lateral support for said page assemblies in said binder.

31. An apparatus a set forth in claim 22 wherein said magnet portion of each of said page assemblies includes an opening which extends through said magnet portion, said binder includes a support which is connected with said binder and extends through the openings in said magnet portions to stabilize said page assemblies in said binder.

32. Apparatus as set forth in claim 23 wherein said base member is a magnet or a strip of magnetic material.

33. An apparatus comprising:

a first page assembly including a first magnet;

said first page assembly includes a magnet portion, a hinge portion, and a display portion, all formed as one single unitary piece; said hinge portion being disposed between said magnet portion and said display portion.

a second page assembly for placement in a overlying relationship with said first page assembly, said second page assembly including a second magnet for releasably attaching said second page assembly to said first page assembly.

34. Apparatus as set forth in claim 33 wherein said first and second magnets are magnetically attracted to each other thereby to form a stack in which said second page assembly is releasably attached to said first page assembly.

35. Apparatus as set forth in claim 33 wherein each one of said first and second page assemblies has a respective inner side portion for connection with a binder and respective opposite outer side portion, said first and second magnets being located on said inner side portions of said page assemblies when said first and second page assemblies are mounted in said binder.

36. Apparatus as set forth in claim 33 wherein said first page assembly includes a metal strip adjacent said first magnet for magnetic attraction by said second magnet of said second page assembly for releasably attaching said second page assembly to said first page assembly.

37. Apparatus as set forth in claim 33 wherein said second page assembly includes a magnet portion, a hinge portion, and a display portion, all formed as one piece.

38. Apparatus as set forth in claim 33 wherein said first page assembly is made from flexible plastic material, and said magnet portion includes a magnet embedded in or adhered to a first portion of said flexible plastic material, said hinge portion includes a sheet-form second portion of said flexible plastic material, and said display portion includes a third portion of said flexible plastic material that is adapted to secure a display item on said page assembly in a binder, said hinge portion enabling pivotal movement of said display portion relative to said magnet portion and relative to said binder to move said display item between a position overlying a back cover of said binder and a position overlying a front cover of said binder.

39. Apparatus as set forth in claim 33 wherein said hinge portion of said first page assembly includes a predetermined weakened portion at which said hinge portion is bendable to enable pivotal movement of said display portion.

40. Apparatus as set forth in claim 33 wherein said magnet portion comprises a strip magnet or bar magnet.

41. Apparatus as set forth in claim 33 wherein said magnet portion comprises a plurality of magnet pieces embedded in and completely enclosed by a plastic material.

42. Apparatus as set forth in claim 33 wherein said magnet portion comprises a strip magnet or bar magnet adheared to a plastic material, said plastic material also forming said hinge portion of said first page assembly.

43. Apparatus as set forth in claim 33 further including means connected with said page assemblies for providing additional lateral support for said page assemblies in said binder.

44. An apparatus as set forth in claim 33 further including means for securing said first and second page assemblies in a binder.

45. Apparatus as set forth in claim 34 wherein said binder includes a base member to which said stack is magnetically attracted thereby to mount said first and second page assemblies in said binder.

46. Apparatus as set forth in claim 34 further including a plurality of page assemblies in addition to said first and second page assemblies, each additional page assembly including a respective magnet, said first and second magnets and said magnets of said additional page assemblies together forming said stack.

47. Apparatus as set forth in claim 45 wherein in which said base member is a magnet.

48. Apparatus as set forth in claim 45 wherein said base member is not a magnet but is made from a magnetic material.

49. Apparatus as set forth in claim 46 wherein said binder includes a base member of magnetic material to which said stack is magnetically attracted thereby to mount said first and second page assembleis and said plurality of additional page assemblies in a binder.

50. Apparatus as set forth in claim 44 wherein said means for securing comprises a base member to which said stack of magnets is attracted to secure said page assemblies in said binder.

51. Apparatus as set forth in claim 50 wherein said base member is a magnet or a strip of magnetic material.

* * * * *

UNITED STATES PATENT AND TRADEMARK OFFICE

CERTIFICATE OF CORRECTION

PATENT NO. : 6,793,251 B2
DATED : September 21, 2004
INVENTOR(S) : Daniel H. Stark It is certified that error appears in the above-identified patent and that said Letters Patent is hereby corrected as shown below:

Column 8,
Line 42, after “assemblies” change “ha” to -- has --.
Line 46, before “when” change “assembiles” to -- assemblies --.
Line 51, before “to” change “adheared” to -- adhered --.
Line 58, after “a” change “postion” to -- position --.

Column 9,
Line 43, after “from” insert -- a --.

Column 10,
Line 25, after “a (2nd occurrence)” change “a” to -- an --.
Line 50, after “from” insert -- a --.

Column 11,
Line 5, after “magnet” change “adheared” to -- adhered --.

Signed and Sealed this

Twelfth Day of April, 2005

JON W. DUDAS
*Director of the United States Patent and Trademark Office*